US011017711B2

(12) United States Patent
Yuan et al.

(10) Patent No.: US 11,017,711 B2
(45) Date of Patent: May 25, 2021

(54) GATE DRIVING CIRCUIT, DRIVING METHOD, AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Can Yuan, Beijing (CN); Yongqian Li, Beijing (CN); Zhidong Yuan, Beijing (CN); Meng Li, Beijing (CN)

(73) Assignees: Hefei Xmsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 39 days.

(21) Appl. No.: 16/619,757

(22) PCT Filed: Jun. 6, 2019

(86) PCT No.: PCT/CN2019/090332
§ 371 (c)(1),
(2) Date: Dec. 5, 2019

(87) PCT Pub. No.: WO2020/019884
PCT Pub. Date: Jan. 30, 2020

(65) Prior Publication Data

US 2020/0302854 A1 Sep. 24, 2020

(30) Foreign Application Priority Data

Jul. 26, 2018 (CN) ..... 201810831211.8

(51) Int. Cl.
*G09G 3/20* (2006.01)

(52) U.S. Cl.
CPC ..... *G09G 3/2092* (2013.01); *G09G 2310/08* (2013.01); *G09G 2330/021* (2013.01)

(58) Field of Classification Search
CPC ..... G09G 3/2092; G09G 2310/08; G09G 2330/021
See application file for complete search history.

(56) References Cited

U.S. PATENT DOCUMENTS

2012/0105414 A1* 5/2012 Yu ..... G09G 3/3674 345/211
2014/0078125 A1* 3/2014 Gondo ..... G09G 3/3677 345/209

(Continued)

FOREIGN PATENT DOCUMENTS

CN 102063876 A 5/2011
CN 103703504 A 4/2014

(Continued)

*Primary Examiner* — Ariel A Balaoing
(74) *Attorney, Agent, or Firm* — The Webb Law Firm

(57) ABSTRACT

The present disclosure provides a gate driving circuit and a driving method, and a display device. The gate driving circuit includes: a plurality of first gate driving units, ith first gate driving unit being configured to output a first gate driving signal to ith row of gate line in a display phase; a plurality of first control modules, mth first control module being configured to control mth second gate driving unit to output a second gate driving signal to mth row of gate line in a vertical blanking phase; nth first control module being configured to control nth second gate driving unit not to output the second gate driving signal in the vertical blanking phase; a plurality of second control modules, kth second control module being configured to control kth second gate driving unit not to output the second gate driving signal in the vertical blanking phase.

20 Claims, 9 Drawing Sheets

(56) References Cited

U.S. PATENT DOCUMENTS

| | | | | |
|---|---|---|---|---|
| 2017/0256198 | A1* | 9/2017 | Hwang | G09G 3/3266 |
| 2018/0025695 | A1* | 1/2018 | Han | G09G 3/3677 345/213 |
| 2018/0137825 | A1* | 5/2018 | An | G09G 3/3266 |
| 2019/0004355 | A1* | 1/2019 | Zeng | G06F 3/0443 |
| 2019/0096353 | A1* | 3/2019 | Tanaka | G06F 3/0416 |

FOREIGN PATENT DOCUMENTS

| | | | |
|---|---|---|---|
| CN | 105243996 | A | 1/2016 |
| CN | 106128384 | A | 11/2016 |
| CN | 107515689 | A | 12/2017 |
| JP | 2005-173245 | A | 6/2005 |

* cited by examiner

GATE DRIVING CIRCUIT, DRIVING METHOD, AND DISPLAY DEVICE

CROSS-REFERENCE TO RELATED APPLICATIONS

The present application is a U.S. National Stage Application under 35 U.S.C. § 371 of International Patent Application No. PCT/CN2019/090332, filed on Jun. 6, 2019, which claims priority to China Patent Application No. 201810831211.8 filed on Jul. 26, 2018, the disclosure of both which are incorporated by reference herein in entirety.

TECHNICAL FIELD

The present disclosure relates to the field of display technology, and especially to a gate driving circuit, a driving method, and a display device.

BACKGROUND

At present, gate driving units in a gate driving circuit each outputs a gate driving signal to a corresponding row of gate line row by row sequentially. Therefore, pixels are sequentially compensated for row by row when necessary.

SUMMARY

According to one aspect of embodiments of the present disclosure, a gate driving circuit is provided. The gate driving circuit comprises: a plurality of first gate driving units, wherein ith first gate driving unit of the plurality of first gate driving units is configured to output a first gate driving signal to ith row of gate line in a display phase of a frame, wherein $1 \leq i \leq M$, and M is the number of the plurality of first gate driving units; a plurality of second gate driving units, wherein ith second gate driving unit of the plurality of second gate driving units is connected to ith row of gate line; a plurality of first control modules, wherein: mth first control module of the plurality of first control modules is configured to, according to a first control signal and the first gate driving signal output to mth row of gate line, control mth second gate driving unit to output a second gate driving signal to mth row of gate line in a vertical blanking phase of the frame, wherein $1 \leq m \leq M$, nth first control module of other than mth first control module of the plurality of first control modules is configured to, according to the first control signal and the first gate driving signal output to nth row of gate line, control nth second gate driving unit not to output the second gate driving signal to nth row of gate line in the vertical blanking phase of the frame, wherein $1 \leq n \leq M$, n is different from m, and n and m have a same parity; and a plurality of second control modules, wherein kth second control module of the plurality of second control modules is configured to according to a second control signal and the first gate driving signal output to kth row of gate line, control kth second gate driving unit not to output the second gate driving signal to kth row of gate line in the vertical blanking phase, wherein $1 \leq k \leq M$, and k and m have different parities.

In some embodiments, mth first control module is configured to, in response to the first control signal and the first gate driving signal output to mth row of gate line, control a power supply voltage terminal to be connected to mth second gate driving unit within a time period of outputting the first gate driving signal to mth row of gate line in the display phase, and not to be connected to mth second gate driving unit within other time periods in the display phase; nth first control module is configured to, in response to the first control signal and the first gate driving signal output to nth row of gate line, control the power supply voltage terminal not to be connected to nth second gate driving unit within the display phase; and kth second control module is configured to, in response to the second control signal and the first gate driving signal output to kth row of gate line, control the power supply voltage terminal not to be connected to kth second gate driving unit within the display phase.

In some embodiments, the first control signal comprises a first control sub-signal and a second control sub-signal; wherein jth first control module of the plurality of first control modules comprises: a first transistor, of which a first electrode is connected to the power voltage terminal; a second transistor, of which a first electrode is connected to a second electrode of the first transistor; and a third transistor, of which a first electrode is connected to the second electrode of the second transistor, and a second electrode is connected to jth second gate driving unit; wherein one of the first transistor, the second transistor, and the third transistor is turned on in response to the first gate driving signal output to jth row of gate line, one of the other two of the first transistor, the second transistor, and the third transistor, in response to the first control sub-signal, is turned on within the time period of outputting a first gate driving signal to mth row of gate line in the display phase, and turned off within the other time periods, and the other of the other two is turned on within the time period of outputting the first gate driving signal to mth row of gate line in the display phase in response to the second control sub-signal; wherein $1 \leq j \leq M$, and j and m have a same parity.

In some embodiments, the second control signal comprises a third control sub-signal and a fourth control sub-signal; wherein kth second control module comprises: a fourth transistor, of which a first electrode of the fourth transistor is connected to the power voltage terminal; a fifth transistor, of which a first electrode is connected to a second electrode of the fourth transistor; and a sixth transistor, of which a first electrode is connected to a second electrode of the fifth transistor, and a second electrode is connected to kth second gate driving unit; wherein one of the fourth transistor, the fifth transistor, and the sixth transistor is turned on in response to the first gate driving signal output to kth row of gate line, one of the other two of the fourth transistor, the fifth transistor, and the sixth transistor is turned off within the display phase in response to the third control sub-signal, and the other of the other two of the fourth transistor, the fifth transistor, and the sixth transistor is turned off or turned on within the display phase in response to the fourth control sub-signal.

In some embodiments, the first control sub-signal and the fourth control sub-signal are complementary, and the second control sub-signal and the third control sub-signal are complementary.

In some embodiments, jth first control module of the plurality of first control modules comprises: a first transistor, of which a first electrode is connected to the power voltage terminal; and a second transistor, of which a first electrode is connected to a second electrode of the first transistor, and a second electrode is connected to jth second gate driving unit; wherein one of the first transistor and the second transistor is turned on in response to the first gate driving signal output to jth row of gate line, and the other is turned on within the time period of outputting the first gate driving signal to mth row of gate line in the display phase, and turned off within the other time periods in response to the first control signal; wherein $1 \leq j \leq M$, and j and m have a same parity.

In some embodiments, kth second control module comprises: a third transistor, of which a first electrode is connected to the power voltage terminal; and a fourth transistor, of which a first electrode is connected to a second electrode of the third transistor, and a second electrode is connected to kth second gate driving unit; wherein one of the third transistor and the fourth transistor is turned on in response to the first gate driving signal output to kth row of gate line, and the other is turned off within the display phase in response to the second control signal.

In some embodiments, mth first control module is configured to, in response to the first control signal, input the first gate driving signal output to mth row of gate line to mth second gate driving unit within a time period of outputting the first gate driving signal to mth row of gate line in the display phase, and not input the first gate driving signal output to mth row of gate line to mth second gate driving unit within other time periods in the display phase; nth first control module is configured to, in response to the first control signal, not input the first gate driving signal output to nth row of gate line to nth second gate driving unit within the display phase; and kth first control module of the plurality of first control modules is configured to, in response to the second control signal, not input the first gate driving signal output to kth row of gate line to kth second gate driving unit within the display phase.

In some embodiments, jth first control module of the plurality of first control modules comprises: a first transistor, of which a first electrode is configured to receive the first gate driving signal output to jth row of gate line, and a second electrode is connected to jth second gate driving unit; wherein the first transistor, in response to the first control signal, is turned on within the time period of outputting the first gate driving signal to mth row of gate line in the display phase, and turned off within the other time periods; wherein $1 \leq j \leq M$, and j and m have a same parity.

In some embodiments, wherein kth second control module comprises: a second transistor, of which a first electrode is configured to receive the first gate driving signal output to kth row of gate line, and a second electrode is connected to kth second gate driving unit; wherein the second transistor is turned off within the display phase in response to the second control signal.

In some embodiments, mth second gate driving unit of the plurality of second gate driving units comprises: a bootstrap module configured to, within the vertical blanking phase, pull up a potential of a pull-up node under control of a first clock signal and output the second gate driving signal to mth row of gate line through an output terminal, wherein the pull-up node is charged within a time period of outputting a first gate driving signal to mth row of gate line in the display phase; and a reset module configured to, within the vertical blanking phase, pull down potentials of the pull-up node and the output terminal under control of a second clock signal.

In some embodiments, the first gate driving signal output to one of two adjacent rows of gate lines overlaps in timing with the first gate driving signal output to the other of the two adjacent rows of gate lines.

In some embodiments, m varies with varying frames.

According to another aspect of embodiments of the present disclosure, display device is provided. The display device comprises: the gate driving circuit according to any one of the above embodiments.

According to still another aspect of embodiments of the present disclosure, a driving method for the gate driving circuit according to any one of the above embodiments is provided. The driving method comprises: selecting a number m from 1 to M randomly; applying the first control signal to each of the plurality of first control modules to control mth second gate driving unit to output the second gate driving signal to mth row of gate line in the vertical blanking phase, and to control nth second gate driving unit not to output the second gate driving signal to nth row of gate line in the vertical blanking phase; and applying the second control signal to each of the plurality of the second control modules to control kth second gate driving unit not to output the second gate driving signal to kth row of gate line in the vertical blanking phase.

In some embodiments, the driving method further comprises: controlling ith first gate driving unit to output the first gate driving signal to ith row of gate line in the display phase.

In some embodiments, applying the first control signal to each of the plurality of first control modules comprises: applying the first control signal to mth first control module to control a power supply voltage terminal to be connected to mth second gate driving unit within a time period of outputting the first gate driving signal to mth row of gate line in the display phase, and not to be connected to mth second gate driving unit within other time periods in the display phase; and applying the first control signal to nth first control module to control the power supply voltage terminal not to be connected to nth second gate driving unit within the display phase; applying the second control signal to each of the plurality of second control modules comprises: applying the second control signal to kth second control module to control the power supply voltage terminal not to be connected to kth second gate driving unit within the display phase.

In some embodiments, applying the first control signal to each of the plurality of first control modules comprises: applying the first control signal to mth first control module to input the first gate driving signal output to mth row of gate line to mth second gate driving unit within a time period of outputting the first gate driving signal to mth row of gate line in the display phase, and not input the first gate driving signal output to mth row of gate line to mth second gate driving unit within other time periods in the display phase; and applying the first control signal to nth first control module to not input the first gate driving signal output to nth row of gate line to nth second gate driving unit; applying the second control signal to each of the plurality of second control modules comprises: applying the second control signal to kth second control module to not input the first gate driving signal output to kth row of gate line to kth second gate driving unit.

Other features, aspects and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute part of this specification, illustrate exemplary embodiments of the present disclosure and, together with this specification, serve to explain the principles of the present disclosure.

The present disclosure can be understood more clearly from the following detailed description with reference to the accompanying drawings, in which.

Figure 1:
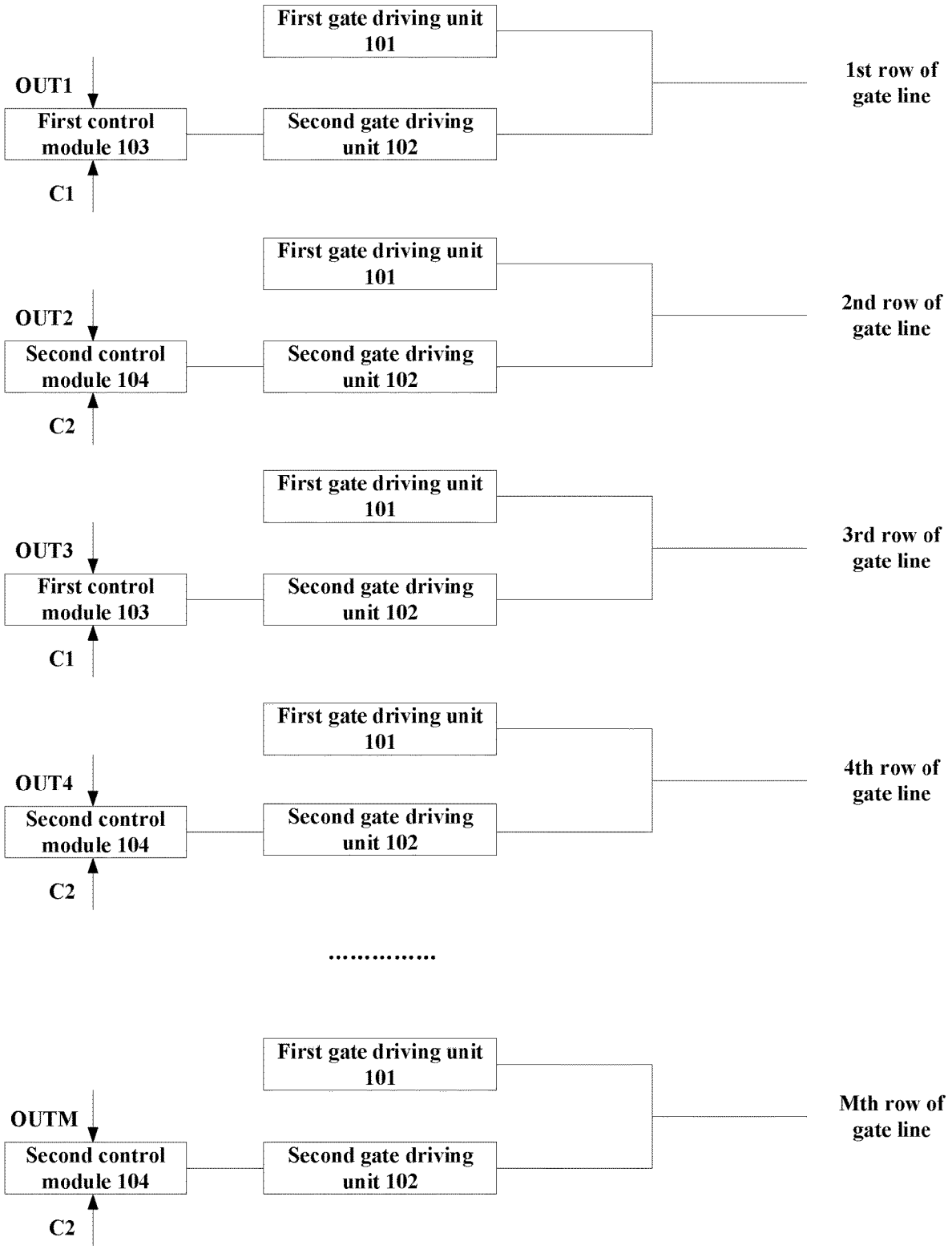
FIG. 1 is a schematic structural view showing a gate driving circuit according to one embodiment of the present disclosure.

It should be understood that the dimensions of the various parts shown in the accompanying drawings are not necessarily drawn according to the actual scale. In addition, the same or similar reference signs are used to denote the same or similar components.

DETAILED DESCRIPTION

Various exemplary embodiments of the present disclosure will now be described in detail with reference to the accompanying drawings. The following description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The use of the terms "first", "second" and similar words in the present disclosure do not denote any order, quantity or importance, but are merely used to distinguish between different parts. A word such as "comprise", "have" or variants thereof means that the element before the word covers the element(s) listed after the word without excluding the possibility of also covering other elements. The terms "up", "down", or the like are used only to represent a relative positional relationship, and the relative positional relationship may be changed correspondingly if the absolute position of the described object changes.

In the present disclosure, when it is described that a specific component is disposed between a first component and a second component, there may be an intervening component between the specific component and the first component or between the specific component and the second component. When it is described that a specific part is connected to other parts, the specific part may be directly connected to the other parts without an intervening part, or not directly connected to the other parts with an intervening part.

Unless otherwise defined, all terms (including technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not to be interpreted in an idealized or extremely formalized sense.

Techniques, methods, and apparatus known to those of ordinary skill in the relevant art may not be discussed in detail, but where appropriate, these techniques, methods, and apparatuses should be considered as part of this specification.

The inventors have found that, streaks may appear in the display screen when compensation is made for the pixels row by row, thereby affecting the display effect.

In order to solve the above problem, a gate driving circuit is provided in embodiments of the present disclosure. The gate driving circuit can randomly output a gate driving signal to a certain row of gate line in a vertical blanking phase of a frame.

FIG. 1 is a schematic structural view showing a gate driving circuit according to one embodiment of the present disclosure.

As shown in FIG. 1, the gate driving circuit comprises a plurality of first gate driving units 101, a plurality of second gate driving units 102, a plurality of first control modules 103, and a plurality of second control modules 104.

Each of the first gate driving units 101 may output a gate driving signal (hereinafter referred to as a first gate driving signal) to a corresponding row of gate line. Each of the second gate driving units 102 may output a gate driving signal (hereinafter referred to as a second gate driving signal) to a corresponding row of gate line.

The ith first gate driving unit 101 is configured to output a first gate driving signal OUTi to ith row of gate line in the display phase of a frame, wherein $1 \leq i \leq M$. Here, M is the number of the plurality of first gate driving units 101. It should be understood that, M is a natural number greater than or equal to two. Here, a frame comprises a display phase and a vertical blanking phase. In the following description, the vertical blanking phase and the display phase mentioned here belong to a same frame unless otherwise specified.

Each of the first gate driving units 101 is configured to output a first gate driving signal to a corresponding row of gate line in the display phase of a frame. For example, the 1st first gate driving unit 101 is configured to output the first gate driving signal OUT1 to the first row of gate line in the display phase of a frame, and the 2nd first gate driving unit 101 is configured to output the first gate driving signal OUT2 to the second row of gate line in the display phase of a frame, and so forth, and mth first gate driving unit 101 is configured to output the first gate driving signal OUTM to mth row of gate line in the display phase of a frame.

The ith second gate driving unit 102 is connected to ith row of gate line. That is, each of the second gate driving units 102 is connected to a corresponding row of gate line. For example, the 1st second gate driving unit 102 is connected to the first row of gate line, the 2nd second gate driving unit 102 is connected to the second row of gate line, and so forth, and mth second gate driving unit 102 is connected to mth row of gate line.

The plurality of first control modules 103 comprise an mth first control module 103 and other first control modules 103 than mth first control module 103. Here, $1 \leq m \leq M$, that is, m is any random number from 1 to M. m may be an odd number or an even number. It should be noted that, FIG. 1 shows a plurality of first control modules 103 by taking m as an odd number.

The mth first control module 103 is configured to, according to the first control signal C1 and the first gate driving signal OUTm output to mth row of gate line, control mth second gate driving unit 102 to output a second gate driving signal to mth row of gate line in the vertical blanking phase.

The nth first control module 103 of other first control modules 103 than mth first control module 103 is configured to, according to the first control signal C1 and the first gate driving signal OUTn output to nth row of gate line, control nth second gate driving unit 102 not to output the second gate driving signal to nth row of gate line in the vertical blanking phase. Here, $1 \leq n \leq M$, wherein n is different from m, and n and m have the same parity. For example, in a case where m is any odd number from 1 to M, n is an odd number from 1 to M other than m. In a case where m is any even number from 1 to M, n is an even number from 1 to M other than m.

The kth second control module 104 of the plurality of second control modules 104 is configured to, according to the second control signal C2 and the first gate driving signal OUTk output to kth row of gate line, control kth second gate driving unit 102 not to output the second gate driving signal to kth row of gate line in the vertical blanking phase. Here, $1 \leq k \leq M$, and k and m have different parities. For example, in a case where m is any odd number from 1 to M, k is any even number from 1 to M; and in a case where m is any even number from 1 to M, k is any odd number from 1 to M.

In other words, under the control of mth first control module 103, only mth second gate driving unit 102 outputs the second gate driving signal to mth row of gate line in the vertical blanking phase, while the other second gate driving units 102 each do not output the second gate driving signal to a corresponding row of gate line in the vertical blanking phase.

In the gate driving circuit of the above embodiments, it is possible to randomly control any one of the second gate driving units to output the second gate driving signal to a corresponding row of gate line in the vertical blanking phase, and control the other second gate driving units each not to output the second gate driving signal to a corresponding row of gate line in the vertical blanking phase. This makes it possible to compensate for a random row of pixels in the vertical blanking phase of each frame, rather than compensating for the pixels row by row. Thus, the display effect is improved.

In some embodiments, m varies with varying frames. This makes it possible to control different second gate driving units 102 to output the second gate driving signals to corresponding row of gate lines in the vertical blanking phase in different frames. Therefore, compensation may be made for different rows of pixels in the vertical blanking phase of different frames, thereby avoiding repeated compensation for a certain row of pixels, and further improving the display effect.

The first control module 103 and the second control module 104 in FIG. 1 may be implemented in different implementations, which will be described in detail below in conjunction with different embodiments.

In some embodiments, mth first control module 103 is configured to, in response to the first control signal C1 and the first gate driving signal OUTm output to mth row of gate line, control the power supply voltage terminal VDD to be connected to mth second gate driving unit 102 within a time period of outputting the first gate driving signal OUTm to mth row of gate line in a display phase, and not to be connected to mth second gate driving unit 102 within other time periods in a display phase; nth first control module 103 is configured to, in response to the first control signal C1 and the first gate driving signal OUTm output to nth row of gate line, control the power supply voltage terminal VDD not to be connected to nth second gate driving unit 102 within the display phase; and kth second control module 104 is configured to, in response to the second control signal C2 and the first gate driving signal OUTk output to kth row of gate line, control the power supply voltage terminal VDD not to be connected to kth second gate driving unit within the display phase.

The structures of the first control module and the second control module according to some implementations of the present disclosure will be introduced below in conjunction with FIGS. 2A, 2B, 3A, and 3B.

Figure 2A:
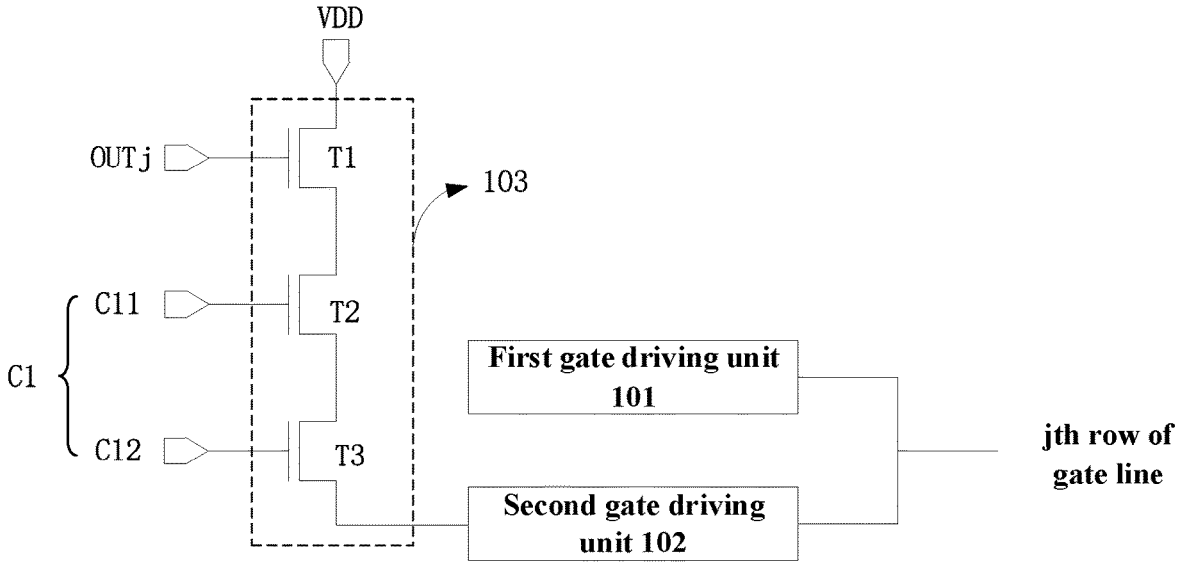
FIG. 2A is a schematic structural view showing a first control module according to one implementation of the present disclosure.

FIG. 2A is a schematic structural view showing a first control module according to one implementation of the present disclosure.

As shown in FIG. 2A, the first control signal C1 comprises a first control sub-signal C11 and a second control sub-signal C12. The jth first control module 103 comprises a first transistor T1, a second transistor T2, and a third transistor T3. Here, $1 \leq j \leq M$, and j and m have the same parity. For example, in a case where m is an odd number, j is any odd number from 1 to M; and in a case where m is an even number, j is any even number from 1 to M.

The first electrode of the first transistor T1 is connected to the power supply voltage terminal VDD, and the second electrode of the first transistor T1 is connected to the first electrode of the second transistor T2. The second electrode of the second transistor T2 is connected to the first electrode of the third transistor T3. The second electrode of the third transistor T3 is connected to jth second gate driving unit 102, for example, the pull-up node PU of jth second gate driving unit 102.

In each of the first control modules 103, one of the first transistor T1, the second transistor T2, and the third transistor T3 is turned on in response to the first gate driving signal OUTj output to jth row of gate line, that is, turned on within the time period of outputting the first gate driving signal OUTj to jth row of gate line in the display phase. One of the other two, in response to the first control sub-signal C11, is turned on within the time period of outputting the first gate driving signal OUTm to mth row of gate line in the display phase and turned off within other time periods in the display phase. The other of the other two, in response to the second control sub-signal C12, is turned on within the time period of outputting the first gate driving signal OUTm to mth row of gate line in the display phase and may be turned on or turned off within other time periods in the display phase.

For example, as shown in FIG. 2A, the control electrode of the first transistor T1 is configured to receive the first gate driving signal OUTj output to jth row of gate line, the control electrode of the second transistor T2 is configured to receive the first control sub-signal C11, and the control electrode of the third transistor T3 is configured to receive the second control sub-signal C12. The first transistor T1 is turned on in response to the first gate driving signal OUTj output to jth row of gate line. The second transistor T2, in response to the first control sub-signal C11, is turned on within the time period of outputting the first gate driving signal OUTm to mth row of gate line in the display phase and turned off within other time periods in the display phase. The third transistor T3, in response to the second control sub-signal C12, is turned on within the time period of outputting the first gate driving signal OUTm to mth row of gate line in the display phase and may be turned on or turned off within other time periods in the display phase.

In the above implementation, the three transistors T1, T2, and T3 in mth first control module 103 are all turned on only within the time period of outputting the first gate driving signal to mth row of gate line in the display phase. Therefore, only mth first control module 103 may input the voltage of the power supply voltage terminal VDD to mth second gate driving unit 102 only within the time period of outputting the first gate driving signal to mth row of gate line in the display phase. None of the other first control modules 103 can input the voltage of the power supply voltage terminal VDD to a corresponding second gate driving unit 102 within the entire display phase.

Figure 2B:
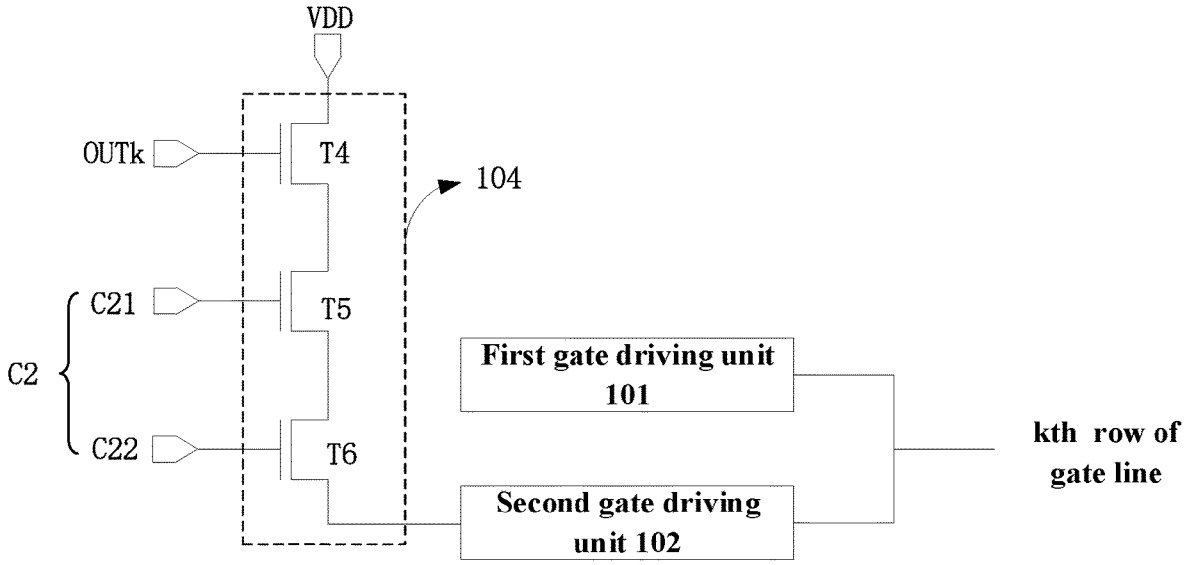
FIG. 2B is a schematic structural view showing a second control module according to one implementation of the present disclosure.

FIG. 2B is a schematic structural view showing a second control module according to one implementation of the present disclosure.

As shown in FIG. 2B, the second control signal C2 comprises a third control sub-signal C21 and a fourth control sub-signal C22. kth second control module 104 comprises a fourth transistor T4, a fifth transistor T5, and a sixth transistor T6.

The first electrode of the fourth transistor T4 is connected to the power supply voltage terminal VDD, and the second electrode of the fourth transistor T4 is connected to the first electrode of the fifth transistor T5. The second electrode of the fifth transistor T5 is connected to the first electrode of the sixth transistor T6. The second electrode of the sixth transistor T6 is connected to kth second gate driving unit 102, for example, the pull-up node PU of kth second gate driving unit 102.

One of the fourth transistor T4, the fifth transistor T5, and the sixth transistor T6 is turned on in response to the first gate driving signal OUTk output to kth row of gate line, that is, turned on within the time period of outputting the first gate driving signal OUTk to kth row of gate line in the display phase. One of the other two is turned off within the display phase in response to the third control sub-signal C21. The other of the other two is turned off or turned on within the display phase in response to the fourth control sub-signal C22.

For example, as shown in FIG. 2B, in each of the second control modules 104, the control electrode of the fourth transistor T4 is configured to receive the first gate driving signal OUTk output to kth row of gate line, and the control electrode of the fifth transistor T5 is configured to receive the third control sub-signal C21, and the control electrode of the sixth transistor T6 is configured to receive a fourth control sub-signal C22. The fourth transistor T4 is turned on in response to the first gate driving signal OUTk output to kth row of gate line. The fifth transistor T5 is turned off within the display phase in response to the third control sub-signal C21. The sixth transistor T6 is turned off or turned on within the display phase in response to the fourth control sub-signal C22.

In the above implementations, within the entire display phase, the three transistors Ti, T2, and T3 in any one of the second control modules cannot be all turned on. Therefore, within the entire display phase, none of the second control modules 104 can input the voltage of the power supply voltage terminal VDD to a corresponding second gate driving unit 102 within the entire display phase.

In some embodiments, the first control sub-signal C11 and the fourth control sub-signal C22 are complementary, and the second control sub-signal C12 and the third control sub-signal C21 are complementary.

Figure 3A:
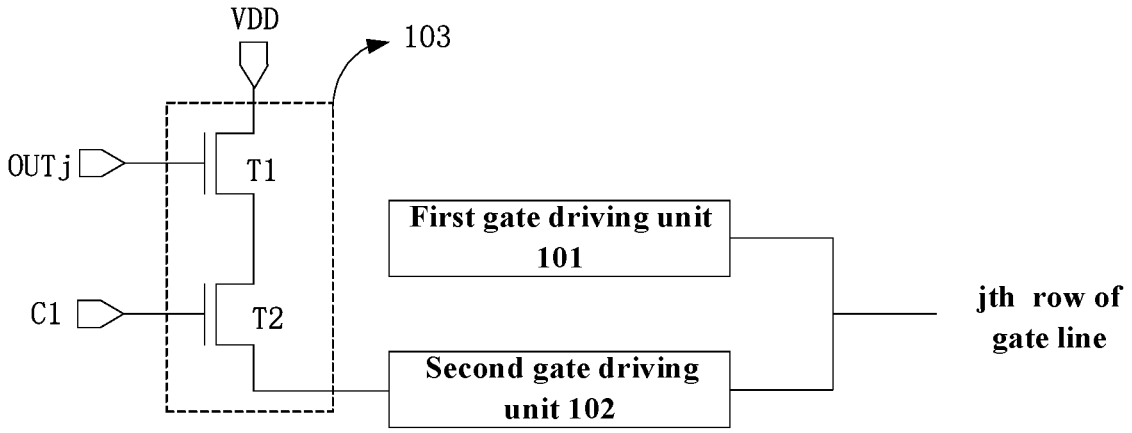
FIG. 3A is a schematic structural view showing a first control module according to another implementation of the present disclosure.

FIG. 3A is a schematic structural view showing a first control module according to another implementation of the present disclosure.

As shown in FIG. 3A, jth first control module 103 comprises a first transistor T1 and a second transistor T2. Here, $1 \leq j \leq M$, and j and m have the same parity. For example, in a case where m is an odd number, j is any odd number from 1 to M; and in a case where m is an even number, j is any even number from 1 to M.

The first electrode of the first transistor T1 is connected to the power supply voltage terminal VDD, and the second electrode of the first transistor T1 is connected to the first electrode of the second transistor T2. The second electrode of the second transistor T2 is connected to jth second gate driving unit 102, for example, the pull-up node PU of jth second gate driving unit 102.

In each of the first control modules 103, one of the first transistor T1 and the second transistor T2 is turned on in response to the first gate driving signal OUTj output to jth row of gate line, the other, in response to the first control signal C1, is turned on within the time period of outputting the first gate driving signal OUTm to mth row of gate line in the display phase and turned off within other time periods in the display phase.

For example, as shown in FIG. 3A, the control electrode of the first transistor T1 is configured to receive the first gate driving signal OUTj output to jth row of gate line, the control electrode of the second transistor T2 is configured to receive the first control signal C1. The first transistor T1 is turned on in response to the first gate driving signal OUTj output to jth row of gate line. The second transistor T2, in response to the first control signal C1, is turned on within the time period of outputting the first gate driving signal OUTm to mth row of gate line in the display phase and turned off within other time periods in the display phase.

In the above implementation, the two transistors T1 and T2 in mth first control module 103 are both turned on only within the time period of outputting the first gate driving signal to mth row of gate line in the display phase. Therefore, only mth first control module 103 may input the voltage of the power supply voltage terminal VDD to mth second gate driving unit 102 only within the time period of outputting the first gate driving signal to mth row of gate line in the display phase. None of the other first control modules 103 can input the voltage of the power supply voltage terminal VDD to a corresponding second gate driving unit 102 within the entire display phase.

Figure 3B:
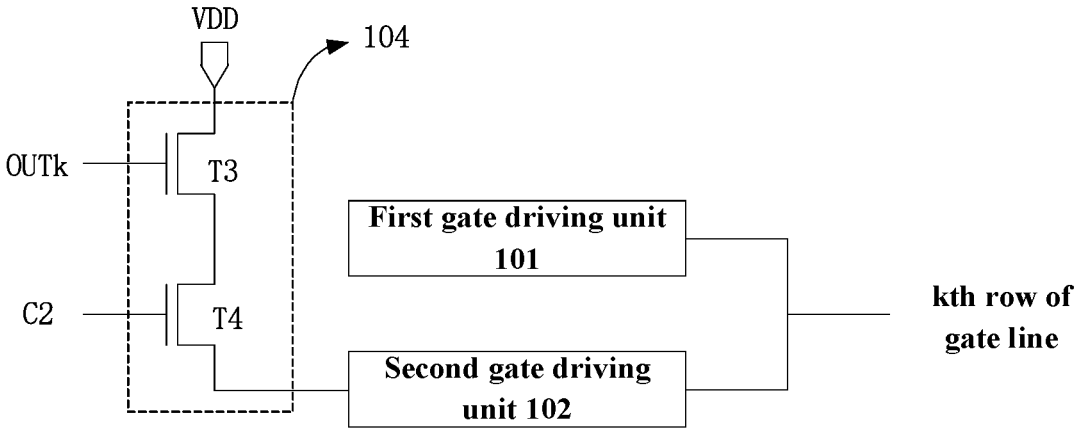
FIG. 3B is a schematic structural view showing a second control module according to another implementation of the present disclosure.

FIG. 3B is a schematic structural view showing a second control module according to another implementation of the present disclosure.

As shown in FIG. 3B, kth second control module 104 comprises a third transistor T3 and a fourth transistor T4.

In each of the second control modules 104, the first electrode of the third transistor T3 is connected to the power supply voltage terminal VDD, and the second electrode of the third transistor T3 is connected to the first electrode of the fourth transistor T4. The second electrode of the fourth transistor T4 is connected to kth second gate driving unit 102, for example, the pull-up node PU of kth second gate driving unit 102.

One of the third transistor T3 and the fourth transistor T4 is turned on in response to the first gate driving signal OUTk output to kth row of gate line, the other is turned off within the display phase in response to the second control signal C2.

As shown in FIG. 3B, the control electrode of the third transistor T3 is configured to receive the first gate driving signal OUTk output to kth row of gate line, and the control electrode of the fourth transistor T4 is configured to receive the second control signal C2. The third transistor T3 is turned on in response to the first gate driving signal OUTk output to kth row of gate line. The fourth transistor T4 is turned off within the display phase in response to the second control signal C2.

In the above implementations, within the entire display phase, the two transistors T1 and T2 in any one of the second control modules cannot be both turned on. Therefore, within the entire display phase, none of the second control modules 104 can input the voltage of the power supply voltage terminal VDD to a corresponding second gate driving unit 102 within the entire display phase.

In other embodiments, mth first control module 103 is configured to, in response to the first control signal C1, to input the first gate driving signal OUTm output to mth row of gate line to mth second gate driving unit 102 within the time period of outputting the first gate driving signal OUTm to mth row of gate line in the display phase, and not input the first gate driving signal OUTm output to mth row of gate line to mth second gate driving unit 102 within other time periods in the display phase; nth first control module 103 is configured to, in response to the first control signal C1, not input the first gate driving signal OUTn output to nth row of gate line to nth second gate driving unit 102 within the display phase; and kth first control module 103 is configured to, in response to the second control signal C2, not input the first gate driving signal OUTk output to kth row of gate line to kth second gate driving unit within the display phase.

The structures of the first control module and the second control module according to some implementations of the present disclosure will be introduced below in conjunction with FIGS. 4A and 4B.

Figure 4A:
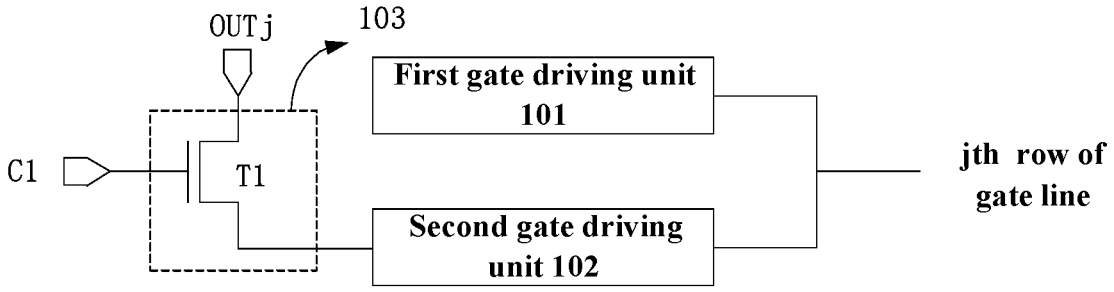
FIG. 4A is a schematic structural view showing a first control module according to still another implementation of the present disclosure.

FIG. 4A is a schematic structural view showing a first control module according to still another implementation of the present disclosure.

As shown in FIG. 4A, jth first control module 103 comprises a first transistor T1. Here, $1 \leq j \leq M$, and j and m have the same parity. For example, in a case where m is an odd number, j is any odd number from 1 to M; and in a case where m is an even number, j is any even number from 1 to M.

The control electrode of the first transistor T1 is configured to receive the first control signal C1, and the first electrode of the first transistor T1 is configured to receive the first gate driving signal OUTj output to jth row of gate line. The second electrode of the first transistor T1 is connected to jth second gate driving unit 102, for example, the pull-up node PU of jth second gate driving unit 102.

The first transistor T1, in response to the first control signal C1, is turned on within the time period of outputting the first gate driving signal OUTm to mth row of gate line in the display phase and turned off within other time periods in the display phase.

In the above implementation, the transistor T1 in mth first control module 103 is turned on only within the time period of outputting the first gate driving signal to mth row of gate line in the display phase. Therefore, only mth first control module 103 may input the voltage of the first gate driving signal OUTm to mth second gate driving unit 102 only within the time period of outputting the first gate driving signal to mth row of gate line in the display phase. None of the other first control modules 103 can input the voltage of a corresponding first gate driving signal to a corresponding second gate driving unit 102 within the entire display phase.

Figure 4B:
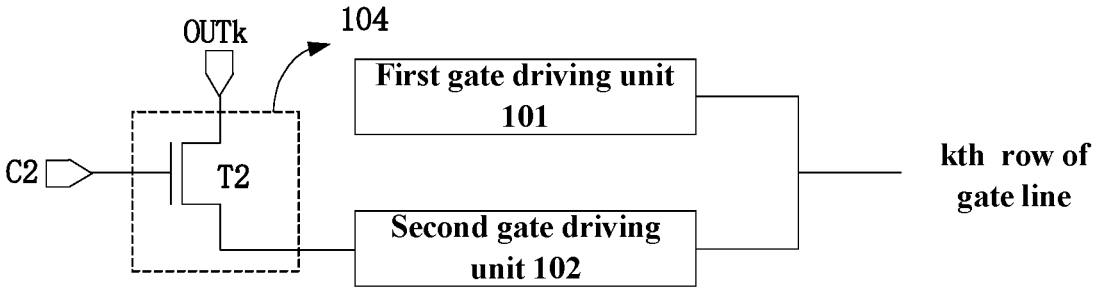
FIG. 4B is a schematic structural view showing a second control module according to yet still another implementation of the present disclosure.

FIG. 4B is a schematic structural view showing a second control module according to yet still another implementation of the present disclosure.

As shown in FIG. 4B, kth second control module 104 comprises a second transistor T2. The control electrode of the second transistor T2 is configured to receive the second control signal C2, the first electrode of the second transistor T2 is configured to receive the first gate driving signal OUTk output to kth row of gate line, and the second electrode of the second transistor T2 is connected to kth second gate driving unit 102, for example, the pull-up node PU of kth second gate driving unit 102.

The second transistor T2 is turned off within the display phase in response to the second control signal C2.

In the above implementations, within the entire display phase, the transistor T1 in any one of the second control modules cannot be turned on. Therefore, within the entire display phase, none of the second control modules 104 can input the voltage of a corresponding gate driving signal to a corresponding second gate driving unit 102 within the entire display phase.

Figure 5:
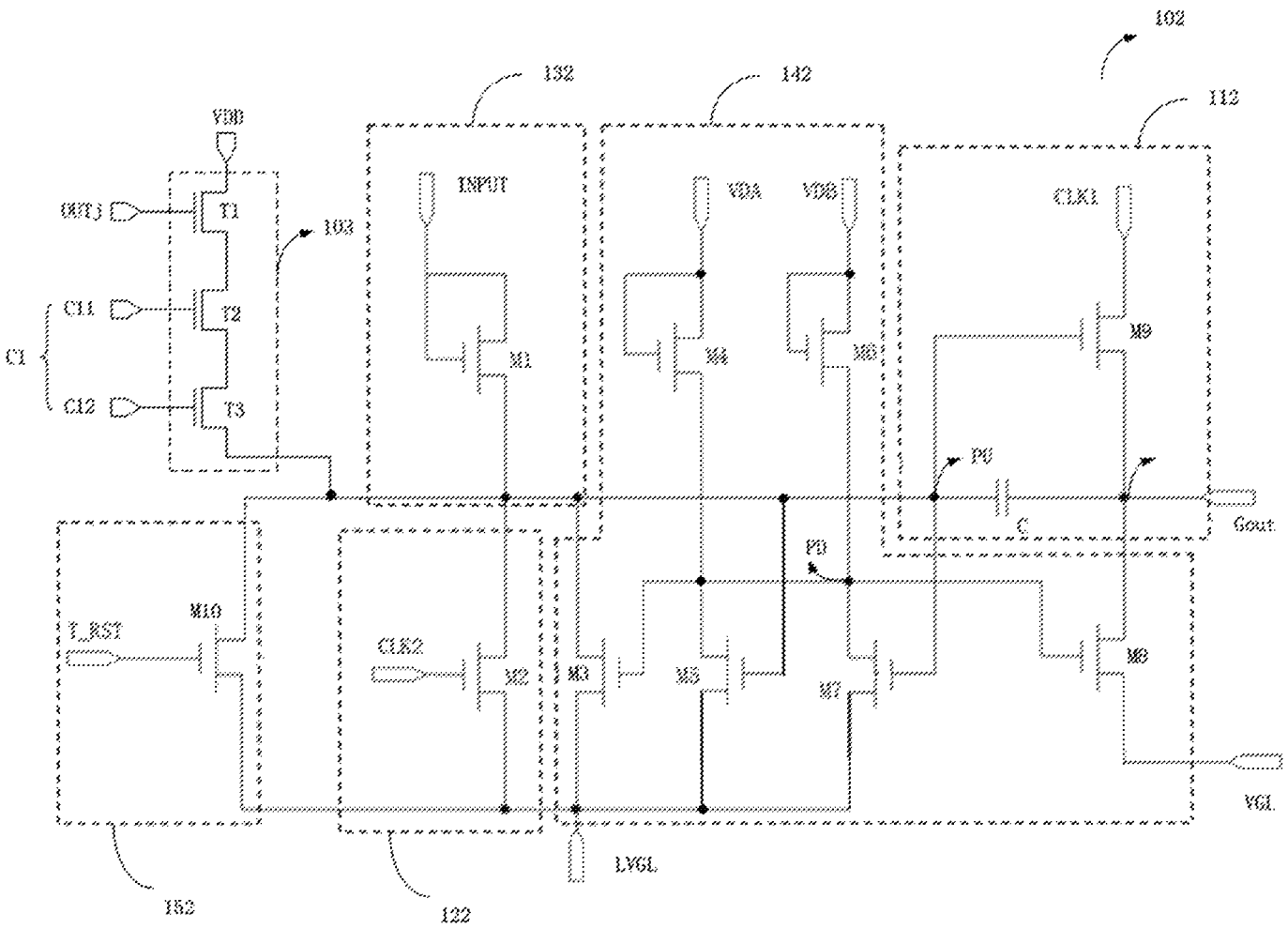
FIG. 5 is a schematic structural view showing a second gate driving unit according to one implementation of the present disclosure.

FIG. 5 is a schematic structural view showing a second gate driving unit according to one implementation of the present disclosure. For ease of understanding, the first control module 103 is shown in FIG. 5 by taking the first control module 103 shown in FIG. 2A as an example. It should be understood that, the first control module 103 here may also be the first control module 103 shown in FIG. 3A or 4A.

mth second gate driving unit 102 will be described as an example in conjunction with FIG. 5. Here, m may be any number from 1 to M.

As shown in FIG. 5, mth second gate driving unit 102 may comprise a bootstrap module 112 and a reset module 122 each connected to the pull-up node PU.

The pull-up node PU is charged within the time period of outputting the first gate driving signal OUTm to mth row of gate line in the display phase.

For example, the first control module 103 shown in FIG. 2A or 3A may input the voltage of the power supply voltage terminal VDD to the pull-up node PU of mth second gate driving unit 102 within the time period of outputting the first gate driving signal OUTm to mth row of gate line in the display phase according to the above manner, so as to charge the pull-up node PU. For another example, the first control module 103 shown in FIG. 4A may input the voltage of the first gate driving signal OUTm to the pull-up node PU of mth second gate driving unit 102 within the time period of outputting the first gate driving signal OUTm to mth row of gate line in the display phase according to the above manner, so as to charge the pull-up node PU.

The bootstrap module 112 is configured to, within the vertical blanking phase, pull a potential of the pull-up node PU up under the control of the first clock signal of the first clock signal terminal CLK1 and output the second gate driving signal Gm to mth row of gate line through the output terminal Gout.

The reset module 122 is configured to pull potentials of the pull-up node PU and the output terminal Gout down under the control of the second clock signal of the second clock signal terminal CLK2 within the vertical blanking phase. For example, the potential of the pull-up node PU is pulled down to the low potential of the first voltage terminal LVGL, and the potential of the output terminal Gout is pulled down to the low potential of the second voltage terminal VGL. In some embodiments, the potential of the first voltage terminal LVGL is lower than that of the second voltage terminal VGL.

In some embodiments, mth second gate driving unit 102 may further comprise an input module 132 configured to charge the pull-up node PU under the control of an input signal of the input signal terminal INPUT (e.g., the second gate driving signal Gm−1 output by m−1th second gate driving unit 102).

In some embodiments, mth second gate driving unit 102 may further comprise a low-level maintaining module 142 configured to maintain the potential of the pull-up node PU and the potential of the output terminal Gout at a low potential. For example, the potential of the pull-up node PU is maintained at the low potential of the first voltage terminal LVGL, and the potential of the output terminal Gout is maintained at the low potential of the second voltage terminal VGL. For example, the low-level maintaining module 142 may be configured to pull down the potential of the pull-down node PD in a case where the potential of the pull-up node PU is pulled up; pull up the potential of the pull-down node PD in a case where the potential of the pull-up node PU is pulled down; and pull down the potential of the pull-up node PU to the low potential of the first voltage terminal LVGL, and the potential of the output terminal Gout to the low potential of the second voltage terminal VGL in a case where the potential of the pull-down node PD is pulled up.

In some embodiments, mth second gate driving unit 102 may further comprise a frame reset module 152 configured to pull down the potentials of the pull-up node PU and the output terminal Gout under the control of the reset signal of the reset terminal T_RST before the display phase of each frame, so as to ensure that the potential of each of the pull-up node PU and the output terminal Gout is at a low potential before the display phase of each frame.

It should be understood that, the first gate driving unit 101 may also be implemented by each module in FIG. 5. It should also be understood that, the structures of the first gate driving unit 101 and the second gate driving unit 102 are not limited to the above implementations. For example, in some implementations, one or more modules in the structure shown in FIG. 5 may be omitted, or other additional modules may be added to the structure shown in FIG. 5, which will not be described in detail here.

The specific implementations of the bootstrapping module 112, the reset module 122, the input module 132, the low-level maintaining module 142, and the frame reset module 152 are introduced below in conjunction with FIG. 5. It is understood by those skilled in the art that, the specific implementations of various modules in the second gate driving unit 102 are not necessarily all implemented according to the specific implementations shown in FIG. 5.

Referring to FIG. 5, the input module 132 may comprise a transistor M1. The gate of transistor M1 is configured to receive an input signal from the signal input terminal INPUT, the first electrode of the transistor M1 is connected to the signal input terminal INPUT, and the second electrode of the transistor M1 is connected to pull-up node PU.

The reset module 122 may comprise a transistor M2. The gate of the transistor M2 is configured to receive a second clock signal from the second clock signal terminal CLK2, the first electrode of the transistor M2 is connected to the pull-up node PU, and the second electrode of the transistor M2 is connected to the first voltage terminal LVGL.

The low-level maintaining module 142 may comprise a transistor M3, a transistor M4, a transistor M5, a transistor M6, a transistor M7, and a transistor M8. The gate of the transistor M3 is connected to the pull-down node PD, the first electrode of the transistor M3 is connected to the pull-up node PU, and the second electrode of the transistor M3 is connected to the first voltage terminal LVGL. The gate and first electrode of the transistor M4 are connected to the third voltage terminal VDA, and the second electrode of the transistor M4 is connected to the pull-down node PD. The gate of the transistor M5 is connected to the pull-up node PU, the first electrode of the transistor M5 is connected to the pull-down node PD, and the second electrode of the transistor M5 is connected to the first voltage terminal LVGL. The gate and the first electrode of the transistor M6 are connected to the fourth voltage terminal VDB, and the second electrode of the transistor M6 is connected to the pull-down node PD. The gate of the transistor M7 is connected to the pull-up node PU, the first electrode of the transistor M7 is connected to the pull-down node PD, and the second electrode of the transistor M7 is connected to the first voltage terminal LVGL. The gate of the transistor M8 is connected to the pull-down node PD, the first electrode of the transistor M8 is connected to the output terminal Gout, and the second electrode of the transistor M8 is connected to the second voltage terminal VGL.

In some embodiments, by controlling the potentials of the third voltage terminal VDA and the fourth voltage terminal VDB, it is possible to control one of the transistors M4 and the control transistor M6 to work and the other not to work. For example, the logic levels of the potentials of the third voltage terminal VDA and the fourth voltage terminal VDB may be reversed. In some embodiments, the logic levels of the potentials of the third voltage terminal VDA and the fourth voltage terminal VDB may be changed every predetermined time (e.g., one frame of time) to switch the operational states of the transistor M4 and the transistor M6. In this way, the service life of the transistor M4 and the transistor M6 may be prolonged.

It should be understood that, in some implementations, the low-level maintaining module 142 may also not comprise the transistor M6 and the transistor M7.

The bootstrap module 112 may comprise a transistor M9 and a capacitor C. The gate of the transistor M9 is connected to the pull-up node PU, the first electrode of the transistor M9 is configured to receive the first clock signal from the first clock signal terminal CLK1, and the second electrode of the transistor M9 is connected to the output terminal Gout. The first terminal of the capacitor C is connected to the pull-up node PU, and the second terminal of the capacitor C is connected to the output terminal Gout.

The frame reset module 152 may comprise a transistor M10. The gate of the transistor M10 is configured to receive a reset signal from the reset terminal T_RST, the first electrode of the transistor M10 is connected to the pull-up node PU, and the second electrode of the transistor M10 is connected to the first voltage terminal LVGL.

Figure 6:
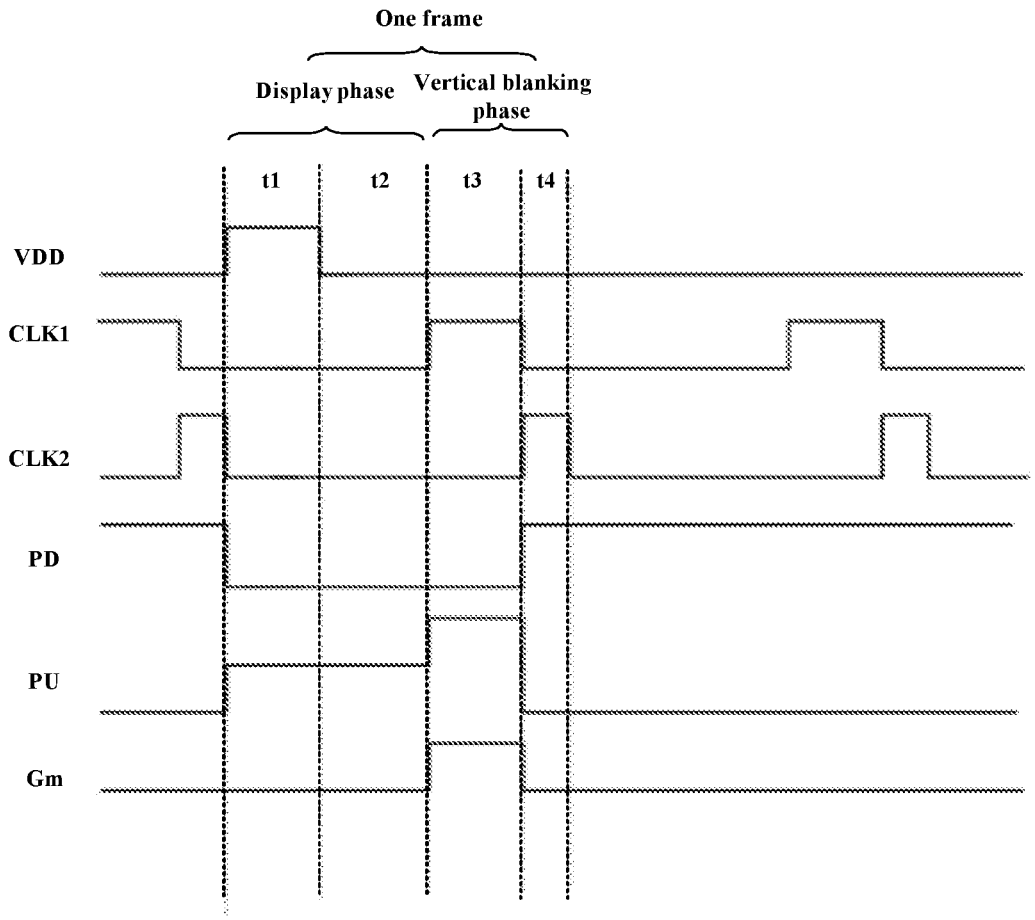
FIG. 6 is a signal timing diagram for mth second gate driving unit.

FIG. 6 is a signal timing diagram for mth second gate driving unit 102. The operation process of mth second gate driving unit 102 will be introduced in conjunction with FIGS. 5 and 6.

As shown in FIG. 6, the operation process of mth second gate driving unit 102 comprises four stages, that is, t1 stage to t4 stage. The t1 stage and the t2 stage belong to the display phase of a frame, and the t3 stage and the t4 stage belong to the vertical blanking phase of this frame. In the t1 stage, the first transistor T1, the second transistor T2, and the third transistor T3 are all turned on. In other stages, the first transistor T1, the second transistor T2, and the third transistor T3 are all turned off.

In the t1 stage of the display phase, the first clock signal of the first clock signal terminal CLK1 is at a low level, the second clock signal of the second clock signal terminal CLK2 and the reset signal of the reset terminal T_RST are at a low level, the potential of the third voltage terminal VDA is at a high level, and the potential of the fourth voltage terminal VDB is at a low level. In this case, the voltage of the power supply voltage terminal VDD is input to the pull-up node PU, and the potential of the pull-up node PU is pulled up, thereby turning on the transistor M5 and the transistor M7. In addition, the transistor M4 is turned on to pull the potential of the pull-down node PD down to a low potential of the first voltage terminal LVGL.

In the t2 stage of the display phase, the potential of the pull-up node PU remains at a high potential.

In the t3 stage of the vertical blanking phase, the clock signal of the first clock signal terminal CLK1 becomes to be at a high level. In this case, under the action of the capacitor C, the potential of the pull-up node PU is further pulled up to turn on the transistor M9. After the transistor M9 is turned on, the output terminal Gout outputs a second gate driving signal Gm of a high level.

In the t4 stage of the vertical blanking phase, the second clock signal of the second clock signal terminal CLK2 becomes to be at a high level, and the transistor M2 is turned on, thereby pulling the potential of the pull-up node PU to a low potential of the first voltage terminal LVGL. In a case where the potential of the pull-up node PU is pulled down, the transistor M5 and the transistor M7 are turned off, thereby pulling the potential of the pull-down node PD high to a high potential of the third voltage terminal VDA. The transistor M3 and the transistor M8 are turned on in a case where the potential of the pull-down node PD is pulled up, thereby pulling the potential of the pull-up node PU down to a low potential of the first voltage terminal LVGL and pulling the potential of the output terminal Gout down to a low potential of the second voltage terminal VGL.

For the first control module 103 shown in FIGS. 2A, 3A, and 4A, and the second control module 104 shown in FIGS. 2B, 3B, and 4B, different first control signals C1 and the second control signals C2 may be applied, which will be introduced below in conjunction with FIGS. 7 and 8.

In the following description, suppose that the transistors Ti, T2, T3, T4, T5, and T6 in FIGS. 2A, 2B, 3A, 3B, 4A, and 4B are all NMOS (N-Metal-Oxide-Semiconductor) transistors. It should be understood that, in other embodiments, these transistors may also be PMOS (P-Metal-Oxide-Semiconductor)transistors.

Figure 7:
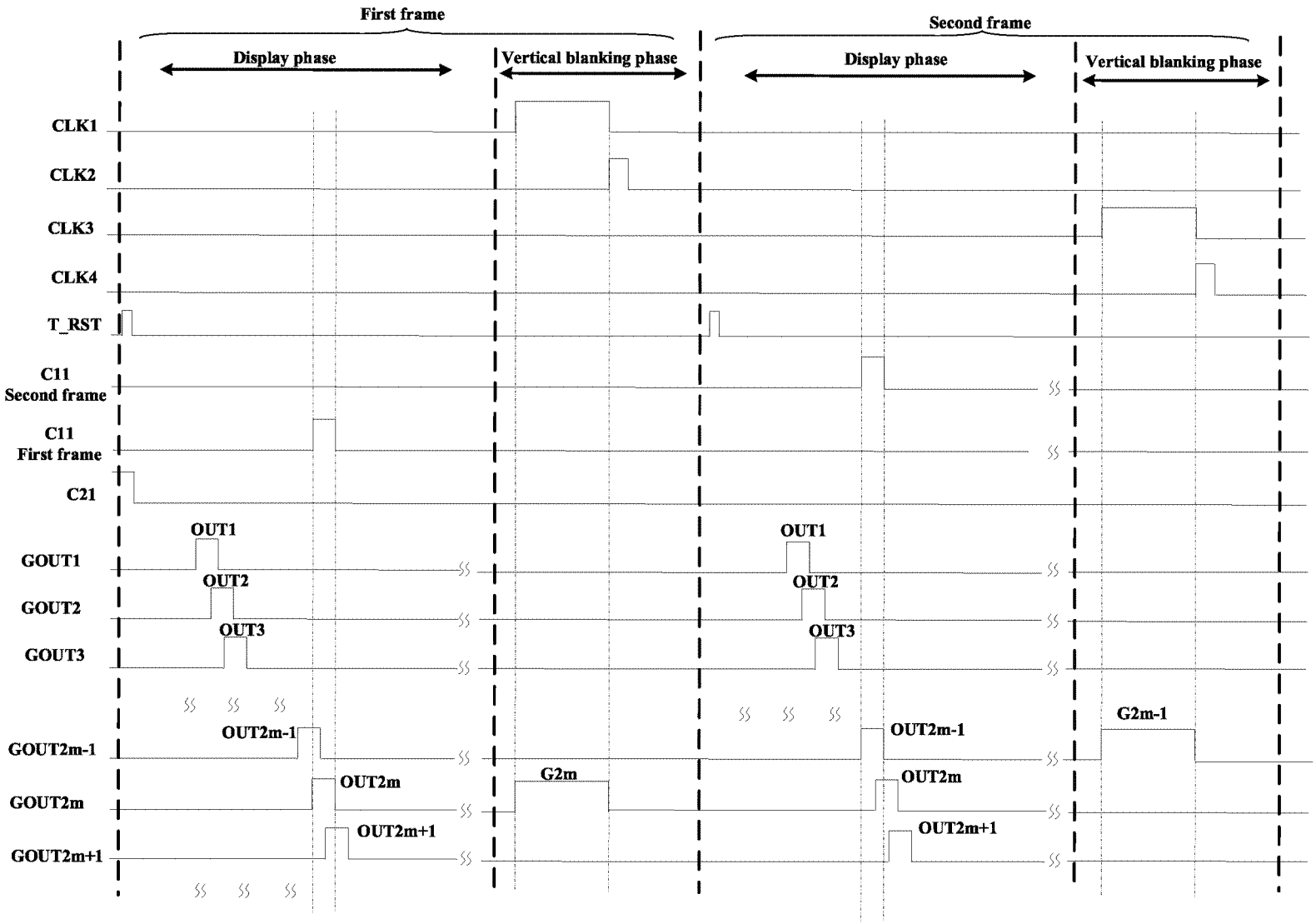
FIG. 7 is a signal timing diagram for a gate driving circuit according to one implementation of the present disclosure.

FIG. 7 is a signal timing diagram for a gate driving circuit according to one implementation of the present disclosure. This implementation is suitable for the first control module 103 shown in FIG. 2A and the second control module 104 shown in FIG. 2B.

In this implementation, the first control signal C1 comprises a first control sub-signal C11 and a second control sub-signal C12, and the second control signal C2 comprises a third control sub-signal C21 and a fourth control sub-signal C22. The first control sub-signal C11 and the fourth control sub-signal C22 are complementary, and the second control sub-signal C12 and the third control sub-signal C21 are complementary. Here, FIG. 7 shows only the first control sub-signal C11 and the third control sub-signal C21.

In FIG. 7, the signal of the first clock signal terminal CLK1 and the signal of the second clock signal terminal CLK2 of the second gate driving unit connected to an even row (for example, the 2mth row) of gate line are CLK1 and CLK2 respectively. The signal of the first clock signal terminal CLK1 and the signal of the second clock signal terminal CLK2 of the second gate driving unit connected to an odd row (for example, the 2m−1th row) of gate line are CLK3 and CLK4 respectively.

In the display phase of each frame, the plurality of first gate driving units 101 each output a first gate driving signal, for example, OUT1, OUT2, OUT3 . . . OUT2*m*−1, OUT2*m* and OUT2*m*+1, to a corresponding row of gate line sequentially row by row.

In some embodiments, the first gate driving signals output to two adjacent rows (e.g., 2m−1th row and 2mth row) of gate lines overlap in timing. For example, the start time of the first gate driving signal OUT2*m*−1 is earlier than the start time of the first gate driving signal OUT2*m*, and the end time of the first gate driving signal OUT2*m*−1 is between the start time and the end time of the first gate driving signal OUT2*m*.

In other embodiments, the first gate driving signals output to two adjacent rows of gate lines may not overlap in timing. For example, the end time of the first gate driving signal OUT2*m*−1 is earlier than or equal to the start time of the first gate driving signal OUT2*m*.

In some embodiments, the first gate driving signals output to adjacent odd row of gate lines do not overlap in timing, and the first gate driving signals output to adjacent even row of gate lines do not overlap in timing as well. For example, the first gate driving signals output to the 2m−1th row and the 2m+1th row of gate line do not overlap in timing, and the first gate driving signals output to the 2m−2th row and the 2mth row of gate line do not overlap in timing.

The timing conditions of various signals during the first frame and the second frame will be respectively described below.

During the first frame, the first control sub-signal C11 is at a high level only within the time period of outputting the first gate driving signal OUT2*m* to the 2mth row of gate line in the display phase of the first frame, and at a low level in other time periods. The fourth control sub-signal C22 is complementary to the first control sub-signal C11, so the fourth control sub-signal C22 is at a low level only within the time period of outputting the first gate driving signal OUT2*m* to the 2mth row of gate line in the display phase of the first frame, and at a high level in other time periods. The third control sub-signal C21 is at a low level within the display phase of the first frame. The second control sub-signal C12 is complementary to the third control sub-signal C21, so the second control sub-signal C12 is at a high level within the display phase of the first frame.

It may be seen that the first control sub-signal C11 and the third control sub-signal C21 for the first frame may only control the 2mth first control module 103 to input the voltage of the power supply voltage terminal VDD to the 2mth second gate driving unit 102 within the time period of outputting the first gate driving signal OUT2*m* to the 2mth row of gate line in the display phase of the first frame. Other first control modules 103 and all the second control modules 104 each may not input the voltage of the power supply voltage terminal VDD to the corresponding second gate driving unit 102 within the entire display phase of the first frame. Therefore, in the vertical blanking phase of the first frame, only the 2mth second gate driving unit 102 outputs the second gate driving signal G2*m* to the 2mth row of gate line.

During the second frame, the first control sub-signal C11 is at a high level only within the time period of outputting the first gate driving signal OUT2*m*−1 to the 2m−1th row of gate line in the display phase of the second frame, and at a low level in other time periods. The fourth control sub-signal C22 is complementary to the first control sub-signal C11, so the fourth control sub-signal C22 is at a low level only within the time period of outputting the first gate driving signal OUT2*m*−1 to the 2m−1th row of gate line in the display phase of the second frame, and at a high level in other time periods. The third control sub-signal C21 is at a low level within the display phase of the second frame. The second control sub-signal C12 is complementary to the third control sub-signal C21, so the second control sub-signal C12 is at a high level within the display phase of the second frame.

It may be seen that the first control sub-signal C11 and the third control sub-signal C21 for the second frame may only control the 2m−1th first control module 103 to input the voltage of the power supply voltage terminal VDD to the 2m−1 second gate driving unit 102 within the time period of outputting the first gate driving signal OUT2*m*−1 to the 2m−1th row of gate line in the display phase of the second frame. Other first control modules 103 and all the second control modules 104 each may not input the voltage of the power supply voltage terminal VDD to the corresponding second gate driving unit 102 within the entire display phase of the second frame. Therefore, in the vertical blanking phase of the second frame, only the 2m−1 second gate driving unit 102 outputs the second gate driving signal G2*m*−1 to the 2m−1th row of gate line.

It should be noted that, in FIG. 7, the gate driving signal output by the gate driving circuit to a corresponding row of gate line during the first frame is shown to comprise a first gate driving signal output in the display phase and a second gate driving signal output in the vertical blanking phase. For example, the gate driving signal GOUT2*m* output by the gate driving circuit to the 2mth row of gate line during the first frame comprises the first gate driving signal OUT2*m* output in the display phase and the second gate driving signal G2*m* output in the vertical blanking phase. The gate driving signal GOUT2*m*−1 output by the gate driving circuit to the 2m−1th row of gate line during the second frame comprises the first gate driving signal OUT2*m*−1 output in the display phase and the second gate driving signal G2*m*−1 output in the vertical blanking phase.

It should be also noted that, although the first control sub-signal C11 shown in FIG. 7 is at a high level within an entirety of the time period of outputting the first gate driving signal OUT2*m* to the 2mth row of gate line in the display phase, this is not restrictive. For example, the first control sub-signal C11 may be at a high level within a part of the time period of outputting the first gate driving signal OUT2*m* to the 2mth row of gate line in the display phase. That is, the rising edge of the first control sub-signal C11 is no earlier than that of the first gate driving signal OUT2*m*, and the falling edge of the first control sub-signal C11 is no later than that of the first gate driving signal OUT2*m*. Therefore, a part of the time period of outputting the first gate driving signal to mth row of gate line may also be considered to be within the time period of outputting the first gate driving signal to mth row of gate line.

Figure 8:
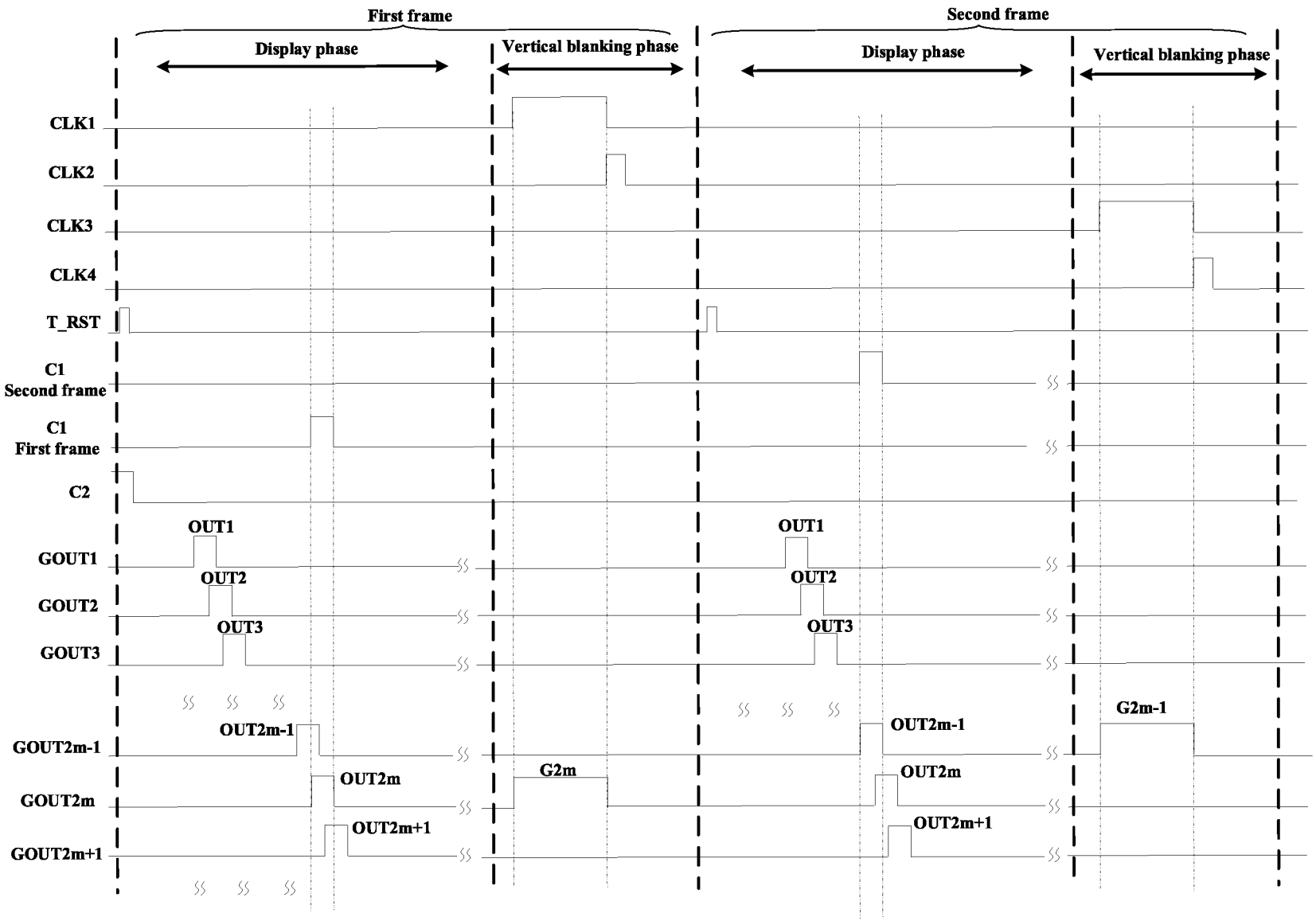
FIG. 8 is a signal timing diagram for a gate driving circuit according to another implementation of the present disclosure.

FIG. 8 is a signal timing diagram for a gate driving circuit according to another implementation of the present disclosure. This implementation is suitable for the first control module 103 shown in FIGS. 3A and 4A and the second control module 104 shown in FIGS. 3B and 4B.

In FIG. 8, the signal of the first clock signal terminal CLK1 and the signal of the second clock signal terminal CLK2 of the second gate driving unit connected to an even row (for example, the 2mth row) of gate line are CLK1 and CLK2 respectively. The signal of the first clock signal terminal CLK1 and the signal of the second clock signal terminal CLK2 of the second gate driving unit connected to an odd row (for example, the 2m−1th row) of gate line are CLK3 and CLK4 respectively.

The timing conditions of various signals during the first frame and the second frame will be respectively described below.

During the first frame, the first control signal C1 is at a high level only within the time period of outputting the first gate driving signal OUT2*m* to the 2mth row of gate line in the display phase of the first frame, and at a low level in other time periods. The second control sub-signal C2 is at a low level within the display phase of the first frame.

It may be seen that the first control signal C1 and the second control signal C2 for the first frame may only control the 2mth first control module 103 to input the voltage of the power supply voltage terminal VDD (see FIGS. 3A and 3B) or the voltage of the first gate driving signal OUT2*m* (see FIGS. 3A and 3B) to the 2m second gate driving unit 102 within the time period of outputting the first gate driving signal OUT2*m* to the 2mth row of gate line in the display phase of the first frame. Other first control modules 103 and all the second control modules 104 may each not input the voltage of the power supply voltage terminal VDD or the first gate driving signal output to a corresponding row of gate line to the corresponding second gate driving unit 102 within the entire display phase of the first frame. Therefore, in the vertical blanking phase of the first frame, only the 2mth second gate driving unit 102 outputs the second gate driving signal G2*m* to the 2mth row of gate line.

During the second frame, the first control signal C1 is at a high level only within the time period of outputting the first gate driving signal OUT2*m*−1 to the 2m−1th row of gate line in the display phase of the second frame, and at a low level in other time periods. The second control sub-signal C2 is at a low level within the display phase of the second frame.

It may be seen that the first control signal C1 and the second control signal C2 for the second frame may only control the 2m−1th first control module 103 to input the voltage of the power supply voltage terminal VDD or the voltage of the first gate driving signal OUT2*m*−1 to the 2m−1 second gate driving unit 102 within the time period of outputting the first gate driving signal OUT2*m*−1 to the 2m−1th row of gate line in the display phase of the second frame. Other first control modules 103 and all the second control modules 104 each may not input the voltage of the power supply voltage terminal VDD or the first gate driving signal output to a corresponding row of gate line to the corresponding second gate driving unit 102 within the entire display phase of the second frame. Therefore, in the vertical blanking phase of the second frame, only the 2m−1 second gate driving unit 102 outputs the second gate driving signal G2*m*−1 to the 2m−1th row of gate line.

It may be seen from FIGS. 7 and 8 that, by applying a corresponding first control signal C1 and second control signal C2, it is possible to allow any one of the second gate driving units to output a second gate driving signal to a corresponding row of gate line within the vertical blanking phase of a frame. In some embodiments, it is possible to allow different second gate drive units to output second gate driving signals to corresponding row of gate lines within a vertical blanking phase of different frames.

In addition, the reset signal of the reset terminal T_RST may be adjusted to be at a high level to reset each second gate driving unit before the display phase of each frame.

The present disclosure also provides a display device, which may comprise the gate driving circuit according to any one of the above embodiments. In some embodiments, the display device may be any product or member having a display function, such as a display panel, a mobile terminal, a television, a display, a notebook computer, a digital photo frame, a navigator, and electronic paper.

The present disclosure also provides a driving method for the gate driving circuit according to any one of the above embodiments.

Figure 9:
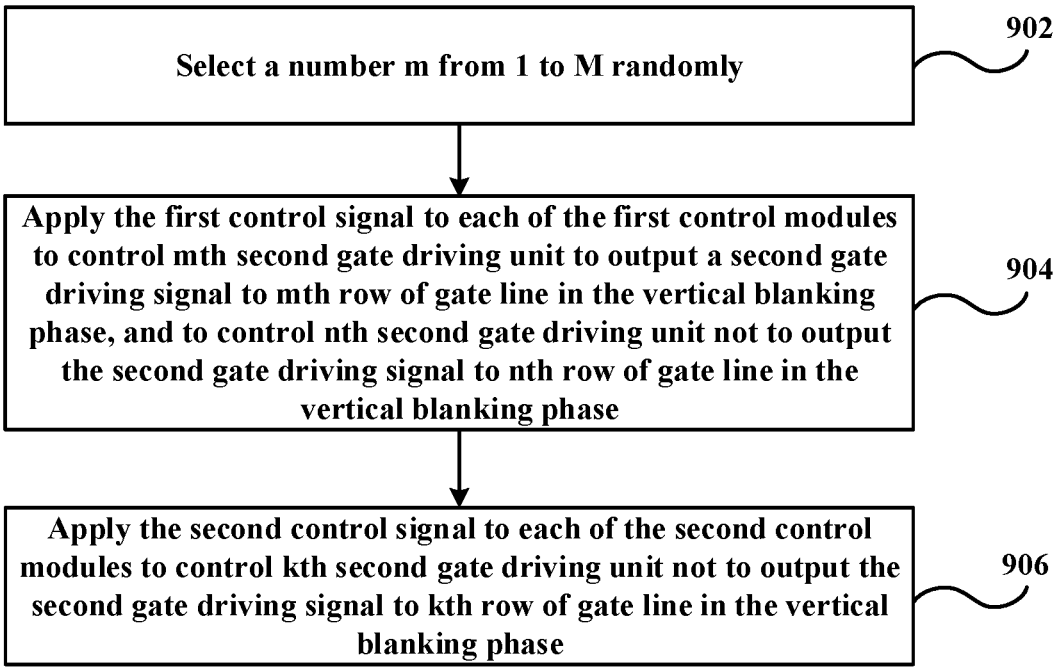
FIG. 9 is a schematic flow chart showing a driving method for a gate driving circuit according to one embodiment of the present disclosure.

FIG. 9 is a schematic flow chart showing a driving method for a gate driving circuit according to one embodiment of the present disclosure.

At step 902, a number m is randomly selected from 1 to M. m may be an odd number or an even number.

For example, the value of m may be determined to be an odd or even number according to the signal output by a counter. Suppose that the counter may output a signal 1 and a signal 2. In a case where the counter outputs a signal 1, m is randomly selected to be an odd number. In a case where the counter outputs a signal 2, m is randomly selected to be an even number.

At step 904, a first control signal is applied to each of the first control modules to control mth second gate driving unit to output a second gate driving signal to mth row of gate line in the vertical blanking phase, and to control nth second gate driving unit not to output the second gate driving signal to nth row of gate line in the vertical blanking phase.

In a case where m is an odd number, n is an odd number from 1 to M other than m; and in a case where m is an even number, n is an even number from 1 to M other than m. The first control signal may be determined according to the value of m.

At step 906, a second control signal is applied to each of the second control modules to control kth second gate driving unit not to output the second gate driving signal to kth row of gate line in the vertical blanking phase.

In a case where m is an odd number, k is any even number from 1 to M; and in a case where m is an even number, k is any odd number from 1 to M. The second control signal may be determined according to the value of m.

In the above embodiments, it is possible to randomly control any one of the second gate driving units to output the second gate driving signal to a corresponding row of gate line in the vertical blanking phase, and control the other second gate driving units each not to output the second gate driving signal to a corresponding row of gate line in the vertical blanking phase. This makes it possible to compensate for a random row of pixels in the vertical blanking phase of each frame, rather than compensating for the pixels row by row, thereby improving the display effect.

In some embodiments, the above driving method may further comprise: ith first gate driving unit of the plurality of first gate driving units is controlled to output the first gate driving signal to ith row of gate line within the display phase of a frame. For example, by controlling the input signal, the first clock signal, the second clock signal, and the reset signal applied to the plurality of first gate driving units, it is possible to control the 1st to Mth gate driving unit of the plurality of first gate driving units to sequentially output the first gate driving signal to a corresponding row of gate line within the display phase of a frame.

In some implementations, the step 904 may be implemented in the following manner: a first control signal is applied to mth first control module to control the power supply voltage terminal to be connected to mth second gate driving unit within the time period of outputting the first gate driving signal to mth row of gate line in the display phase, and not to be connected to mth second gate driving unit within other time periods in the display phase; and a first control signal is applied to nth first control module to control the power supply voltage terminal not to be connected to nth second gate driving unit within the display phase. In this way, it is possible to control mth second gate driving unit to output a second gate driving signal to mth row of gate line in the vertical blanking phase, and to control nth second gate driving unit not to output the second gate driving signal to nth row of gate line in the vertical blanking phase.

In some implementations, the step 906 may be implemented in the following manner: a second control signal is applied to kth second control module to control the power supply voltage terminal not to be connected to kth second gate driving unit within the display phase. In this way, it is possible to control kth second gate driving unit not to output the second gate driving signal to kth row of gate line in the vertical blanking phase.

In other implementations, the step 904 may be implemented in the following manner: a first control signal is applied to mth first control module to input the first gate driving signal output to mth row of gate line to mth second gate driving unit within the time period of outputting the first gate driving signal to mth row of gate line in the display phase, and not input the first gate driving signal output to mth row of gate line to mth second gate driving unit within other time periods in the display phase; and a first control signal is applied to nth first control module to not input the first gate driving signal output to nth row of gate line to nth second gate driving unit. In this way, it is possible to control mth second gate driving unit to output a second gate driving signal to mth row of gate line in the vertical blanking phase, and to control nth second gate driving unit not to output the second gate driving signal to nth row of gate line in the vertical blanking phase.

In other implementations, the step 906 may be implemented in the following manner: a second control signal is applied to kth second control module to not input the first gate driving signal output to kth row of gate line to kth second gate driving unit within the display phase. In this way, it is possible to control kth second gate driving unit not to output the second gate driving signal to kth row of gate line in the vertical blanking phase.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features can be made without departing from the scope and spirit of the present disclosure. The scope of the disclosure is defined by the following claims.

What is claimed is:

1. A gate driving circuit, comprising:

a plurality of first gate driving units, wherein ith first gate driving unit of the plurality of first gate driving units is configured to output a first gate driving signal to ith row of gate line in a display phase of a frame, wherein $1 \leq i \leq M$, and M is the number of the plurality of first gate driving units;

a plurality of second gate driving units, wherein ith second gate driving unit of the plurality of second gate driving units is connected to ith row of gate line;

a plurality of first control modules, wherein:

mth first control module of the plurality of first control modules is configured to, according to a first control signal and the first gate driving signal output to mth row of gate line, control mth second gate driving unit to output a second gate driving signal to mth row of gate line in a vertical blanking phase of the frame, wherein $1 \leq m \leq M$, nth first control module of other than mth first control module of the plurality of first control modules is configured to, according to the first control signal and the first gate driving signal output to nth row of gate line, control nth second gate driving unit not to output the second gate driving signal to nth row of gate line in the vertical blanking phase of the frame, wherein $1 \leq n \leq M$, n is different from m, and n and m have a same parity; and a plurality of second control modules, wherein kth second control module of the plurality of second control modules is configured to according to a second control signal and the first gate driving signal output to kth row of gate line, control kth second gate driving unit not to output the second gate driving signal to kth row of gate line in the vertical blanking phase, wherein $1 \leq k \leq M$, and k and m have different parities.

2. The gate driving circuit according to claim 1, wherein:

mth first control module is configured to, in response to the first control signal and the first gate driving signal output to mth row of gate line, control a power supply voltage terminal to be connected to mth second gate driving unit within a time period of outputting the first gate driving signal to mth row of gate line in the display phase, and not to be connected to mth second gate driving unit within other time periods in the display phase;

nth first control module is configured to, in response to the first control signal and the first gate driving signal output to nth row of gate line, control the power supply voltage terminal not to be connected to nth second gate driving unit within the display phase; and kth second control module is configured to, in response to the second control signal and the first gate driving signal output to kth row of gate line, control the power supply voltage terminal not to be connected to kth second gate driving unit within the display phase.

3. The gate driving circuit according to claim 2, wherein the first control signal comprises a first control sub-signal and a second control sub-signal;

wherein jth first control module of the plurality of first control modules comprises:

a first transistor, of which a first electrode is connected to the power voltage terminal;

a second transistor, of which a first electrode is connected to a second electrode of the first transistor; and a third transistor, of which a first electrode is connected to the second electrode of the second transistor, and a second electrode is connected to jth second gate driving unit;

wherein one of the first transistor, the second transistor, and the third transistor is turned on in response to the first gate driving signal output to jth row of gate line, one of the other two of the first transistor, the second transistor, and the third transistor, in response to the first control sub-signal, is turned on within the time period of outputting a first gate driving signal to mth row of gate line in the display phase, and turned off within the other time periods, and the other of the other two is turned on within the time period of outputting the first gate driving signal to mth row of gate line in the display phase in response to the second control sub-signal;

wherein $1 \leq j \leq M$, and j and m have a same parity.

4. The gate driving circuit according to claim 3, wherein the second control signal comprises a third control sub-signal and a fourth control sub-signal;

wherein kth second control module comprises:

a fourth transistor, of which a first electrode of the fourth transistor is connected to the power voltage terminal;

a fifth transistor, of which a first electrode is connected to a second electrode of the fourth transistor; and a sixth transistor, of which a first electrode is connected to a second electrode of the fifth transistor, and a second electrode is connected to kth second gate driving unit;

wherein one of the fourth transistor, the fifth transistor, and the sixth transistor is turned on in response to the first gate driving signal output to kth row of gate line, one of the other two of the fourth transistor, the fifth transistor, and the sixth transistor is turned off within the display phase in response to the third control sub-signal, and the other of the other two of the fourth transistor, the fifth transistor, and the sixth transistor is turned off or turned on within the display phase in response to the fourth control sub-signal.

5. The gate driving circuit according to claim 4, wherein the first control sub-signal and the fourth control sub-signal are complementary, and the second control sub-signal and the third control sub-signal are complementary.

6. The gate driving circuit according to claim 2, wherein jth first control module of the plurality of first control modules comprises:

a first transistor, of which a first electrode is connected to the power voltage terminal; and a second transistor, of which a first electrode is connected to a second electrode of the first transistor, and a second electrode is connected to jth second gate driving unit;

wherein one of the first transistor and the second transistor is turned on in response to the first gate driving signal output to jth row of gate line, and the other is turned on within the time period of outputting the first gate driving signal to mth row of gate line in the display phase, and turned off within the other time periods in response to the first control signal;

wherein $1 \leq j \leq M$, and j and m have a same parity.

7. The gate driving circuit according to claim 2, wherein kth second control module comprises:

a third transistor, of which a first electrode is connected to the power voltage terminal; and a fourth transistor, of which a first electrode is connected to a second electrode of the third transistor, and a second electrode is connected to kth second gate driving unit;

wherein one of the third transistor and the fourth transistor is turned on in response to the first gate driving signal output to kth row of gate line, and the other is turned off within the display phase in response to the second control signal.

8. The gate driving circuit according to claim 1, wherein:

mth first control module is configured to, in response to the first control signal, input the first gate driving signal output to mth row of gate line to mth second gate driving unit within a time period of outputting the first gate driving signal to mth row of gate line in the display phase, and not input the first gate driving signal output to mth row of gate line to mth second gate driving unit within other time periods in the display phase;

nth first control module is configured to, in response to the first control signal, not input the first gate driving signal output to nth row of gate line to nth second gate driving unit within the display phase; and kth first control module of the plurality of first control modules is configured to, in response to the second control signal, not input the first gate driving signal output to kth row of gate line to kth second gate driving unit within the display phase.

9. The gate driving circuit according to claim 8, wherein jth first control module of the plurality of first control modules comprises:

a first transistor, of which a first electrode is configured to receive the first gate driving signal output to jth row of gate line, and a second electrode is connected to jth second gate driving unit;

wherein the first transistor, in response to the first control signal, is turned on within the time period of outputting the first gate driving signal to mth row of gate line in the display phase, and turned off within the other time periods;

wherein $1 \leq j \leq M$, and j and m have a same parity.

10. The gate driving circuit according to claim 8, wherein kth second control module comprises:

a second transistor, of which a first electrode is configured to receive the first gate driving signal output to kth row of gate line, and a second electrode is connected to kth second gate driving unit;

wherein the second transistor is turned off within the display phase in response to the second control signal.

11. The gate driving circuit according to claim 1, wherein mth second gate driving unit of the plurality of second gate driving units comprises:

a bootstrap module configured to, within the vertical blanking phase, pull up a potential of a pull-up node under control of a first clock signal and output the second gate driving signal to mth row of gate line through an output terminal, wherein the pull-up node is charged within a time period of outputting a first gate driving signal to mth row of gate line in the display phase; and a reset module configured to, within the vertical blanking phase, pull down potentials of the pull-up node and the output terminal under control of a second clock signal.

12. The gate driving circuit according to claim 1, wherein the first gate driving signal output to one of two adjacent rows of gate lines overlaps in timing with the first gate driving signal output to the other of the two adjacent rows of gate lines.

13. The gate driving circuit according to claim 1, wherein m varies with varying frames.

14. A display device, comprising: the gate driving circuit according to any one of claim 1.

15. A driving method for a gate driving circuit, wherein the gate driving circuit comprises:

a plurality of first gate driving units, wherein ith first gate driving unit of the plurality of first gate driving units is configured to output a first gate driving signal to ith row of gate line in a display phase of a frame, wherein $1 \leq i \leq M$, and M is the number of the plurality of first gate driving units;

a plurality of second gate driving units, wherein ith second gate driving unit of the plurality of second gate driving units is connected to ith row of gate line;

a plurality of first control modules, wherein:

mth first control module of the plurality of first control modules is configured to, according to a first control signal and the first gate driving signal output to mth row of gate line, control mth second gate driving unit to output a second gate driving signal to mth row of gate line in a vertical blanking phase of the frame, wherein $1 \leq m \leq M$, nth first control module of other first control modules than mth first control module of the plurality of first control modules is configured to, according to the first control signal and the first gate driving signal output to nth row of gate line, control nth second gate driving unit not to output the second gate driving signal to nth row of gate line in the vertical blanking phase of the frame, wherein $1 \leq n \leq M$, n is different from m, and n and m have a same parity; and a plurality of second control modules, wherein kth second control module of the plurality of second control modules is configured to according to a second control signal and the first gate driving signal output to kth row of gate line, control kth second gate driving unit not to output the second gate driving signal to kth row of gate line in the vertical blanking phase, wherein $1 \leq k \leq M$, and k and m have different parities;

wherein the driving method comprises:

selecting a number m from 1 to M randomly;

applying the first control signal to each of the plurality of first control modules to control mth second gate driving unit to output the second gate driving signal to mth row of gate line in the vertical blanking phase, and to control nth second gate driving unit not to output the second gate driving signal to nth row of gate line in the vertical blanking phase; and applying the second control signal to each of the plurality of the second control modules to control kth second gate driving unit not to output the second gate driving signal to kth row of gate line in the vertical blanking phase.

16. The driving method according to claim 15, further comprising:

controlling ith first gate driving unit to output the first gate driving signal to ith row of gate line in the display phase.

17. The driving method according to claim 15, wherein:

applying the first control signal to each of the plurality of first control modules comprises:

applying the first control signal to mth first control module to control a power supply voltage terminal to be connected to mth second gate driving unit within a time period of outputting the first gate driving signal to mth row of gate line in the display phase, and not to be connected to mth second gate driving unit within other time periods in the display phase; and applying the first control signal to nth first control module to control the power supply voltage terminal not to be connected to nth second gate driving unit within the display phase;

applying the second control signal to each of the plurality of second control modules comprises:

applying the second control signal to kth second control module to control the power supply voltage terminal not to be connected to kth second gate driving unit within the display phase.

18. The driving method according to claim 15, wherein:

applying the first control signal to each of the plurality of first control modules comprises:

applying the first control signal to mth first control module to input the first gate driving signal output to mth row of gate line to mth second gate driving unit within a time period of outputting the first gate driving signal to mth row of gate line in the display phase, and not input the first gate driving signal output to mth row of gate line to mth second gate driving unit within other time periods in the display phase; and applying the first control signal to nth first control module to not input the first gate driving signal output to nth row of gate line to nth second gate driving unit;

applying the second control signal to each of the plurality of second control modules comprises:

applying the second control signal to kth second control module to not input the first gate driving signal output to kth row of gate line to kth second gate driving unit.

19. The gate driving circuit according to claim 6, wherein kth second control module comprises:

a third transistor, of which a first electrode is connected to the power voltage terminal; and a fourth transistor, of which a first electrode is connected to a second electrode of the third transistor, and a second electrode is connected to kth second gate driving unit;

wherein one of the third transistor and the fourth transistor is turned on in response to the first gate driving signal output to kth row of gate line, and the other is turned off within the display phase in response to the second control signal.

20. The gate driving circuit according to claim 9, wherein kth second control module comprises:

a second transistor, of which a first electrode is configured to receive the first gate driving signal output to kth row of gate line, and a second electrode is connected to kth second gate driving unit;

wherein the second transistor is turned off within the display phase in response to the second control signal.

* * * * *